US006369782B2

(12) United States Patent
Shigeta

(10) Patent No.: US 6,369,782 B2
(45) **Date of Patent: *Apr. 9, 2002**

(54) METHOD FOR DRIVING A PLASMA DISPLAY PANEL

(75) Inventor: Tetsuya Shigeta, Yamanashi-ken (JP)

(73) Assignee: Pioneer Electric Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/064,843

(22) Filed: Apr. 23, 1998

(30) Foreign Application Priority Data

Apr. 26, 1997 (JP) ..... 9-123539

(51) Int. Cl.[7] ..... G09G 3/22

(52) U.S. Cl. ..... 345/63; 345/60; 345/77; 345/89; 345/147

(58) Field of Search ..... 345/63, 60, 77, 345/89, 147

(56) References Cited

U.S. PATENT DOCUMENTS 5,187,578 A * 2/1993 Kohgami et al. ..... 348/687
5,436,634 A * 7/1995 Kanazawa ..... 345/67
5,541,618 A * 7/1996 Shinoda ..... 345/60
5,724,054 A * 3/1998 Shinoda ..... 345/60
5,874,932 A * 2/1999 Nagaoka et al. ..... 345/60
5,907,316 A * 5/1999 Mikoshiba et al. ..... 345/147
5,940,142 A * 8/1999 Wakitani et al. ..... 348/671
5,943,032 A * 8/1999 Nagaoka et al. ..... 345/63
5,966,107 A * 10/1999 Amemiya ..... 345/60

FOREIGN PATENT DOCUMENTS

JP 7-496636 * 2/1995 ..... G09G/3/28

* cited by examiner

*Primary Examiner*—Bipin Shalwala
*Assistant Examiner*—Vincent E. Kovalick
(74) *Attorney, Agent, or Firm*—Arent Fox Kintner Plotkin & Kahn, PLLC

(57) ABSTRACT

A frame of a video signal is divided into a plurality of sub-frames. Each of the sub-frames is composed by an address period for selecting light emitting pixels or light non-emitting pixels at every scanning line in accordance with a pixel data, and a discharge sustaining period for causing a light emitting pixel to emit at a number of times in accordance with weighting of each sub-frame. A plurality of sub-frames are adjacently disposed to form a sub-frame block. A reset period is provided in a first sub-frame of the sub-frame block so as to initialize all pixels prior to the address period.

6 Claims, 17 Drawing Sheets

FIG.4

| LUMINANCE LEVEL | PIXEL DATA D | BIT NUMBER CONVERTED PIXEL DATA BD | FIRST CONVERTING TABLE (CONVERTED PIXEL DATA A) | | | | | SUB-FRAME ARRANGEMENT IN ONE FRAME | | | | |
|---|---|---|---|---|---|---|---|---|---|---|---|---|
| | | | SF0, (1) | SF4, (15) | SF1, (2) | SF2, (4) | SF3, (8) | SF0 (1) | SF4 (15) | SF1 (2) | SF2 (4) | SF3 (8) |
| 0 | 00000 | 0000 | 0 | 0 | 0 | 0 | 0 | | | | | |
| 1 | 00001 | 0001 | 1 | 0 | 0 | 0 | 0 | ○ | | | | |
| 2 | 00010 | 0010 | 0 | 0 | 1 | 0 | 0 | | | ○ | | |
| 3 | 00011 | 0011 | 1 | 0 | 1 | 0 | 0 | ○ | | ○ | | |
| 4 | 00100 | 0100 | 0 | 0 | 0 | 1 | 0 | | | | ○ | |
| 5 | 00101 | 0101 | 1 | 0 | 0 | 1 | 0 | ○ | | | ○ | |
| 6 | 00110 | 0110 | 0 | 0 | 1 | 1 | 0 | | | ○ | ○ | |
| 7 | 00111 | 0111 | 1 | 0 | 1 | 1 | 0 | ○ | | ○ | ○ | |
| 8 | 01000 | 1000 | 0 | 0 | 0 | 0 | 1 | | | | | ○ |
| 9 | 01001 | 1001 | 1 | 0 | 0 | 0 | 1 | ○ | | | | ○ |
| 10 | 01010 | 1010 | 0 | 0 | 1 | 0 | 1 | | | ○ | | ○ |
| 11 | 01011 | 1011 | 1 | 0 | 1 | 0 | 1 | ○ | | ○ | | ○ |
| 12 | 01100 | 1100 | 0 | 0 | 0 | 1 | 1 | | | | ○ | ○ |
| 13 | 01101 | 1101 | 1 | 0 | 0 | 1 | 1 | ○ | | | ○ | ○ |
| 14 | 01110 | 1110 | 0 | 0 | 1 | 1 | 1 | | | ○ | ○ | ○ |
| 15 | 01111 | 1111 | 1 | 0 | 1 | 1 | 1 | ○ | | ○ | ○ | ○ |

FIG.5

| LUMINANCE LEVEL | PIXEL DATA D | BIT NUMBER CONVERTED PIXEL DATA BD | SECOND CONVERTING TABLE [CONVERTED PIXEL DATA B] | | | | | SUB-FRAME ARRANGEMENT IN ONE FRAME | | | | |
|---|---|---|---|---|---|---|---|---|---|---|---|---|
| | | | SF0, (1) | SF4, (15) | SF1, (2) | SF2, (4) | SF3, (8) | SF0 (1) | SF4 (15) | SF1 (2) | SF2 (4) | SF3 (8) |
| 16 | 10000 | 1000 | 1 | 1 | 0 | 0 | 0 | ○ | ○ | | | |
| 17 | 10001 | 1000 | 1 | 1 | 0 | 0 | 0 | ○ | ○ | | | |
| 18 | 10010 | 1001 | 1 | 1 | 1 | 0 | 0 | ○ | ○ | ○ | | |
| 19 | 10011 | 1001 | 1 | 1 | 1 | 0 | 0 | ○ | ○ | ○ | | |
| 20 | 10100 | 1010 | 1 | 1 | 0 | 1 | 0 | ○ | ○ | | ○ | |
| 21 | 10101 | 1010 | 1 | 1 | 0 | 1 | 0 | ○ | ○ | | ○ | |
| 22 | 10110 | 1011 | 1 | 1 | 1 | 1 | 0 | ○ | ○ | ○ | ○ | |
| 23 | 10111 | 1011 | 1 | 1 | 1 | 1 | 0 | ○ | ○ | ○ | ○ | |
| 24 | 11000 | 1100 | 1 | 1 | 0 | 0 | 1 | ○ | ○ | | | ○ |
| 25 | 11001 | 1100 | 1 | 1 | 0 | 0 | 1 | ○ | ○ | | | ○ |
| 26 | 11010 | 1101 | 1 | 1 | 1 | 0 | 1 | ○ | ○ | ○ | | ○ |
| 27 | 11011 | 1101 | 1 | 1 | 1 | 0 | 1 | ○ | ○ | ○ | | ○ |
| 28 | 11100 | 1110 | 1 | 1 | 0 | 1 | 1 | ○ | ○ | | ○ | ○ |
| 29 | 11101 | 1110 | 1 | 1 | 0 | 1 | 1 | ○ | ○ | | ○ | ○ |
| 30 | 11110 | 1111 | 1 | 1 | 1 | 1 | 1 | ○ | ○ | ○ | ○ | ○ |
| 31 | 11111 | 1111 | 1 | 1 | 1 | 1 | 1 | ○ | ○ | ○ | ○ | ○ |

METHOD FOR DRIVING A PLASMA DISPLAY PANEL

BACKGROUND OF THE INVENTION

The present invention relates to a method for driving a plasma display panel (PDP).

Recently, as a display device becomes large in size, thickness of the display device is desired to be thin. Therefore, various types of display devices of thin thickness are provided. As one of the display devices, an ACPDP is known.

A conventional ACPDP comprises a plurality of column electrodes (address electrodes), and a plurality of row electrodes (sustaining electrodes) formed in pairs and disposed to intersect the column electrodes. A pair of row electrodes form one row (one scanning line) of an image. The column electrodes and the row electrodes are covered by dielectric layers respectively, at a discharge space. At the intersection of each of the column electrodes and each pair of row electrodes, a discharge cell (pixel) is formed.

As a method for displaying an image on the PDP by controlling a tone of the image, each frame (field) of a video signal is divided into N pieces of sub-frames (sub-fields), and each sub-frame (sub-field) emits the light for a time length corresponding to a weight applied to each bit of n-bit pixel data (so-called sub-frame method).

In the method, if a pixel data for each pixel has 8 bits as shown in FIG. 16, each frame is divided into eight sub-frames, SF0, SF1, SF2, . . . SF7. The sub-frames SF0 to SF7 emit the light by sustaining discharge at 1 time, 2 times, 4 times, 8 times, 16 times, 32 times, 64 times and 128 times, respectively, in order.

Each sub-frame comprises an all at once reset period, address period, discharge sustaining period and wall charge erasing period. Driving pulses are applied to all electrodes as shown in FIG. 17, as described hereinafter.

First, a reset pulse RPx of negative polarity is applied to each of the row electrodes as sustain electrodes X1–Xj. At the same time, a reset pulse RPy of positive polarity is applied to each of the row electrodes Y1–Yj. Thus, all of the row electrodes in pairs in the PDP are excited to discharge, thereby producing charged particles in the discharge space at the discharge cell. Thereafter, when the discharge is finished, wall charge is formed and accumulated on the discharge cell (An all at once reset period).

Then, pixel data pulse DP1–DPk corresponding to the pixel data for every row are applied to the column electrodes A1–Ak. At that time, scanning pulses (selecting and erasing pulses) SP are applied to the row electrodes Y1–Yj in order in synchronism with the timings of the data pulse DP1–DPk.

At that time, only in the discharge cell (unlighted pixel, unlighted cell) to which the scanning pulse SP and the pixel data pulse DP are simultaneously applied, the discharge occurs, so that the wall charge produced at the all at once reset period is erased.

On the other hand, in the discharge cell (lighted pixel, lighted cell) to which only the scanning pulse SP is applied, the discharge does not occur. Thus, the wall charge produced at the all at once reset period is held. Namely, a predetermined amount of the wall charge is selectively erased in accordance with the display data (An address period).

Next, a discharge sustaining pulse IPx of positive polarity is applied to the row electrodes X1–Xj, and a discharge sustaining pulse IPy of positive polarity is applied to the row electrodes Y1–Yj at offset timing from the discharge row pulses IPx.

During the discharge sustaining pulses are continuously applied, the discharge cell which holds the wall charge sustains the discharge and emission of light (A discharge sustaining period).

Thus, the image is displayed by repeating the display cycle (one sub-frame) comprising the all at once reset period, address period, discharge sustaining period and wall charge erasing period.

As above described, in the selecting and erasing address method, it is necessary to provide the reset period at the start of the sub-frame so that all discharge cells are reset-discharged to produce the wall charge in each discharge cell. In the case of display data of 8 bits, for example, at least reset discharges of eight times if necessary. The reset discharge is comparatively strong discharge. In addition, since the reset discharge has not relation to the tone of the display, the discharge causes the contrast of the display to reduce.

SUMMARY OF THE INVENTION

An object of the present invention is to provide a method for driving a plasma display panel which may improve the contrast of the display.

According to the present invention, there is provided a method for driving a plasma display panel wherein one frame of a video signal is divided into a plurality of sub-frames, each of the sub-frames is composed by an address period for selecting light emitting pixels or light non-emitting pixels at every scanning line in accordance with a pixel data, and a discharge sustaining period for causing a light emitting pixel to emit at a number of times in accordance with weighting of each sub-frame.

The method comprises disposing adjacently a plurality of sub-frames to form at least one sub-frame block, and providing a reset period in a first sub-frame of the sub-frame block so as to initialize all pixels prior to the address period.

The method further comprises forming a wall charge in each of the all pixels in the reset period, and selectively erasing the wall charge in each pixel in one of the address periods of the sub-frame block in accordance with the pixel data.

The method further comprises forming a wall charge in each of the all pixels in the reset period, thereafter erasing the wall charge in all pixels, selectively forming a wall charge of each pixel in each address period of the sub-frame block in accordance with the pixel data, and providing a whole surface erasing period after each discharge sustaining period in the sub-frame block, for erasing wall charges in emitting pixel.

A first sub-frame in the sub-frame block comprises a lightly weighted sub-frame, a sub-frame following the first sub-frame comprises a heavily weighted sub-frame.

A first sub-frame in the sub-frame block comprises a most lightly weighted divided sub-frame in a divided sub-frame group which is formed by dividing a plurality of heavily weighted sub-frames including a most heavily weighted sub-frame, a sub-frame following the first sub-frame in the sub-frame block includes one of most heavily weighted sub-frames.

In an aspect of the invention, at least two sub-frames include at least two divided sub-frames which are formed by dividing a most heavily weighted sub-frame.

The pixel data comprises n bits, the one frame is divided into n sub-frames, sub-frames in the sub-frame block are arranged in such an arrangement that the first is a first sub-frame in which the number of times of light emitting in the discharge sustaining period is $L \cdot 2^k$, the second is a second sub-frame in which the number of times of light emitting in the discharge sustaining period is $L \cdot (2^{m+k} - 2^k)$ ($0 \leqq k < m < n$, $m+k < n$, $1 \leqq L$), the first sub-frame is selectively caused to be an emitting state when luminance level is less than $2^m$, and the first and second sub-frames are caused to be emitting state when luminance level is more than $2^m$.

These and other objects and features of the present invention will become more apparent from the following detailed description with reference to the accompanying drawings.

BRIEF DESCRIPTION OF DRAWINGS

FIG. 4 shows a first converting table of correcting data for the pixel;

FIG. 5 shows a second converting table of correcting data for the pixel;

DETAILED DESCRIPTION OF THE PREFERRED EMBODIMENT

Figure 1:
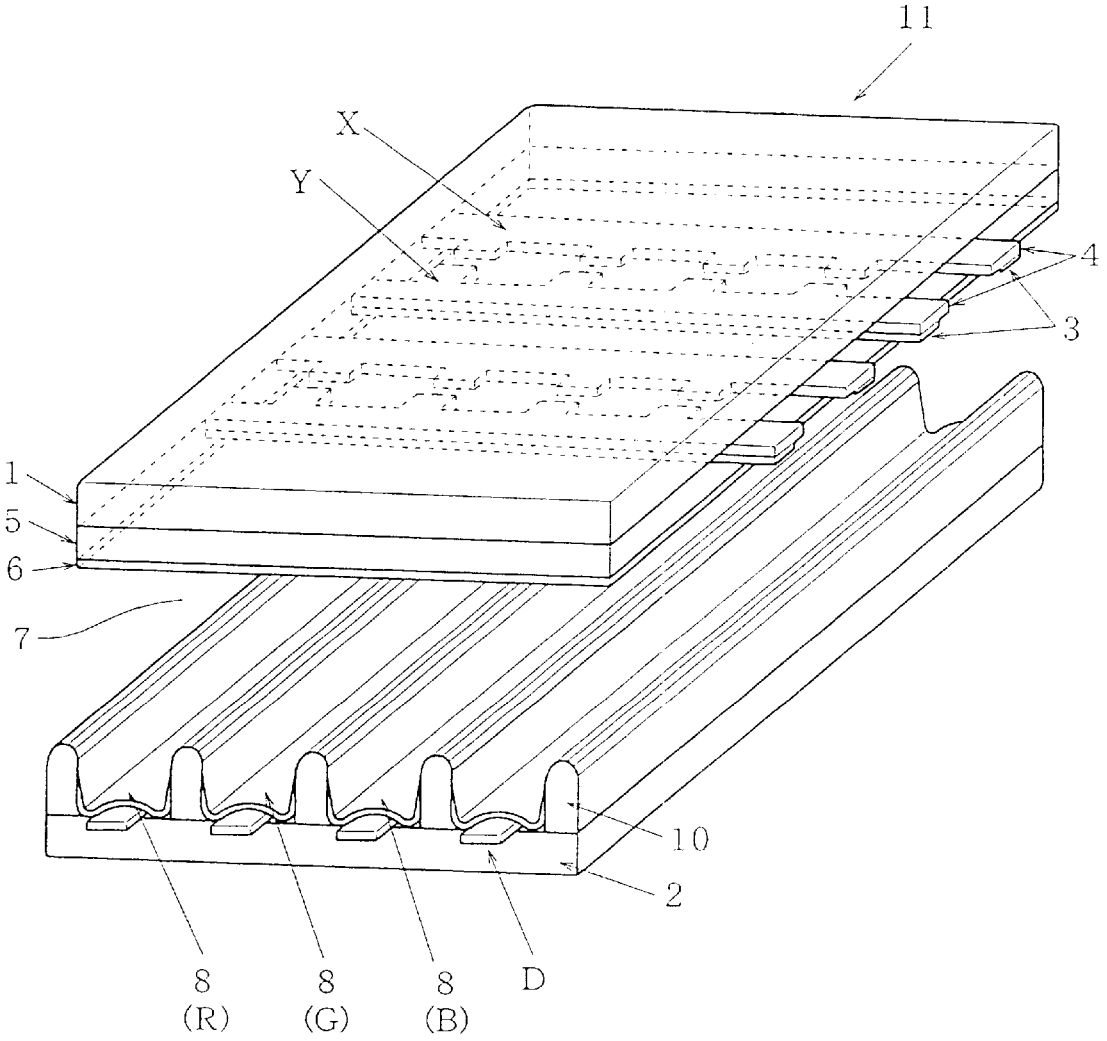
FIG. 1 is a schematic perspective view a plasma display panel according to the present invention.

FIG. 1 shows an ACPDP of a reflection type of three-electrode according to the present invention. An ACPDP 11 comprises a pair of glass substrates 1 and 2 disposed opposite to each other, interposing a discharge space 7 therebetween. The glass substrate 1 as a display portion has row electrodes (sustain electrodes) X and Y which are alternately disposed in pairs to be parallel with each other at the inside portion thereof. The row electrodes X and Y are covered by a dielectric layer 5 for producing wall charge. A protection layer 6 made of MgO is coated on the dielectric layer 5.

Each of the row electrodes X and Y comprises a transparent electrode 4 formed by a transparent conductive film having a large width and bus electrode (metallic electrode) 3 formed by a metallic film having a small width and layered on the transparent electrode 4.

On the glass substrate 2 as a rear member, a plurality of elongated barriers 10 are provided at the inside portion thereof for defining the discharge space 7. The barrier 10 extends in the direction perpendicular to the row electrodes X, Y. Between the barriers 10, column electrodes (address electrodes) D are formed to intersect the row electrodes X and Y of the glass substrate 1. A phosphor layer 8 having a predetermined luminous color R, G or B covers each of the column electrodes D and opposite side portions of the barrier 10. The discharge space 7 is filled with discharge gas consisting of neon mixed with xenon. Thus, a discharge cell (pixel) is formed at the intersection of the row electrodes in pairs and the column electrodes.

Figure 2:
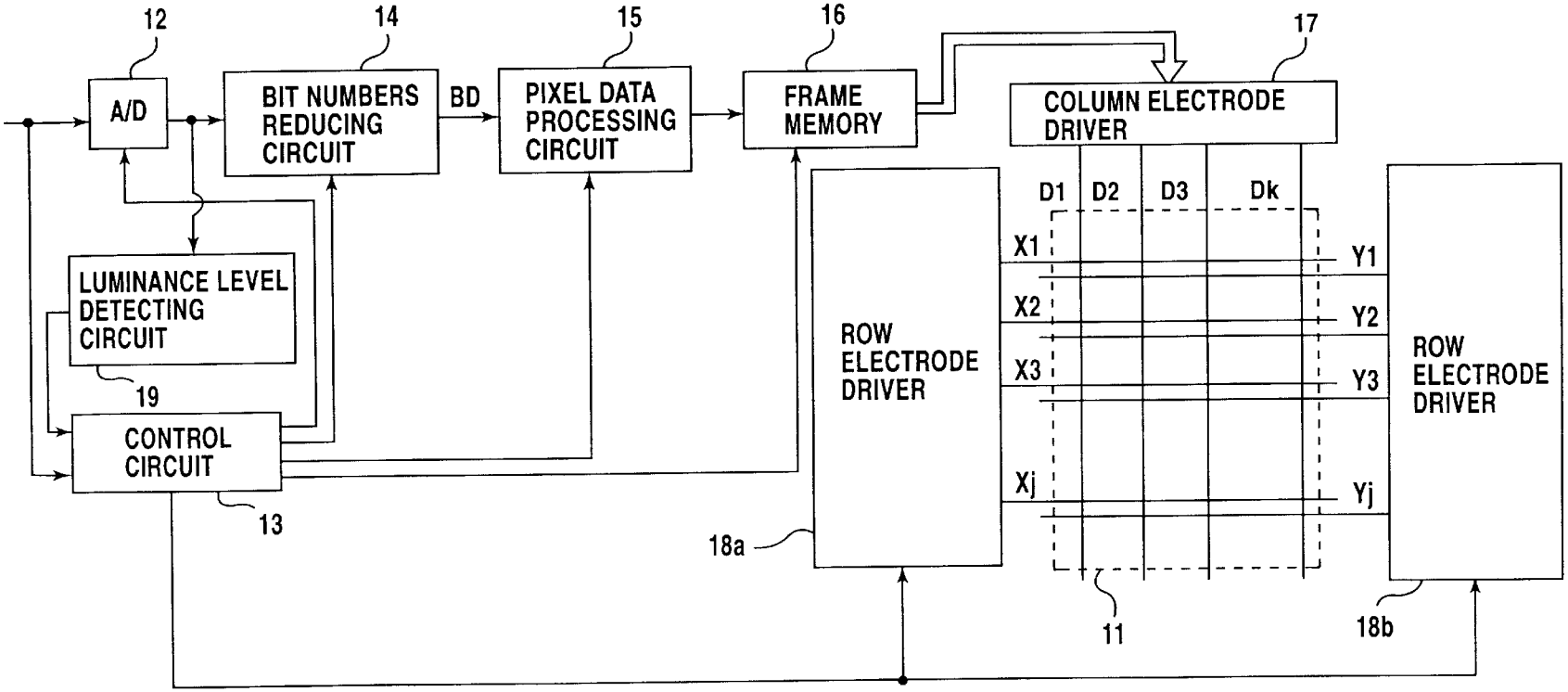
FIG. 2 is a block diagram showing a driving system for the plasma display panel.

Referring to FIG. 2 showing a driving system for displaying the half tone for the PDP 11, an input video signal is applied to an A/D converter 12 and a control circuit 13.

The A/D converter 12 samples the input video signal in accordance with a clock signal from the control circuit 13 to provide a pixel data (display data) D of n bits (n is an integer and $2 \leqq n$) corresponding to a pixel. The pixel data are applied to a bit numbers reducing circuit 14 and to a luminance level detecting circuit 19. A luminance level signal from the luminance level detecting circuit 19 is applied to the control circuit 13. For example, in the case of five bits pixel data, the luminance level detecting circuit 19 produces a luminance level signal representing that the luminance level of the pixel data is within a range of 0–15 or within a range of 16–31.

In accordance with the luminance level signal, the control circuit 13 produces a control signal for controlling the bit numbers reducing operation and a selection signal for controlling the production of a converted pixel data HD which are applied to the bit numbers reducing circuit 14 and a pixel data processing circuit 15.

In response to the control signal from the control circuit 13, the bit numbers reducing circuit 14 converts a pixel data D of n bits to a bit number converting pixel data BD of n-i bits (i is an integer and $1 < i < n$), thereby reducing the bit numbers. For example, in the case of five bits pixel data, lower four bits except the upper most bit are derived when the luminance level is between 0 and 15 (see FIG. 4), thereby converting the five bits data to four bits data. Similarly, when the luminance level is between 16 and 31, the upper four bits except the lower most bit are derived (FIG. 5). Namely, the bit numbers reducing circuit 14 produces a bit number converted pixel data BD of four bits.

The pixel data processing circuit 15 comprises a data converting circuit for processing data in response to the clock signal and selection signal fed from the control circuit 13.

Figure 3:
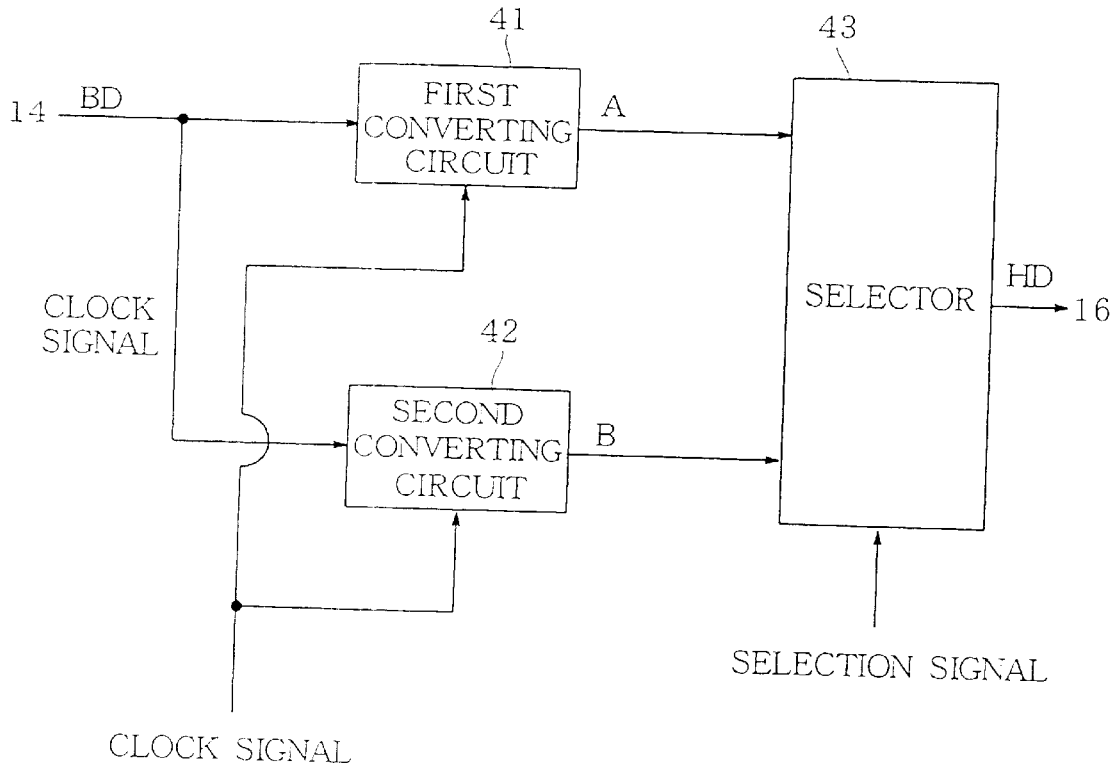
FIG. 3 is a block diagram showing a pixel data converting circuit provided in the driving system.

FIG. 3 shows the data converting circuit.

The data converting circuit comprises first and second converting circuits 41 and 42, and a selector 43.

The first data converting circuit 41 converts the bit number converted pixel data BD of bits, for example 4 bits applied from the bit numbers reducing circuit 14 to a converted pixel data A of 5 bits of the corresponding luminance level in accordance with a first converting data table shown in FIG. 4. The pixel data A is applied to the selector 43.

Similarly, the second data converting circuit 42 converts the pixel data BD of 4 bits to a converted pixel data B of 5 bits of the corresponding luminance level in accordance with a second converting data table of FIG. 5. The pixel data B is applied to the selector 43.

The selector 43 applies the pixel data A or B to a frame memory 16 as a converted pixel data HD.

The frame memory 16 is operated to store the pixel data HD in order in dependency on the write-in control signal from the control circuit 13, and to read the pixel data HD stored therein in dependency on the read-out control signal from the control circuit 13. The read-out pixel data are applied to a column electrode driver 17.

The frame memory 16 reads the pixel data of the bit corresponding to each sub-frame in order in accordance with the display order of the sub-frame.

The control circuit 13 produces various timing signals such as a reset timing, scanning timing, sustaining timing, erasing timing signals corresponding to the horizontal and vertical synchronizing signals of the input video signal. The reset, scanning, sustaining, and erasing timing signals are applied to a row electrode driver 18*a*, and reset, and sustaining timing signals are applied to a row electrode driver 18*b*.

In the PDP 11, a pair of row electrodes X and Y are provided to form one row (one scanning line). The row electrodes X1–Xj are connected to the row electrode driver 18a. The row electrodes Y1–Yj are connected to the row electrode driver 18*b*.

The row electrode driver 18*a* produces a reset pulse RPx (FIG. 7) for initializing wall charges of all of the discharge cells all at once, a scanning pulse (selecting and writing pulse or selecting and erasing pulse) SP for selectively forming or erasing the wall charge in dependency on the pixel data, thereby selecting a lighted pixel (cell) or unlighted pixel (cell), a sustaining pulse IPx for sustaining the lighted pixel or unlighted pixel (namely, sustaining the discharge and emission of light), and an erasing pulse EP for erasing the wall charge of the discharge cell, corresponding to the timing signals from the control circuit 13. These pulses are applied to the row electrodes X1–Xj. The scanning pulse SP is sequentially applied from the row electrode X1 to the row electrode Xj in order.

The row electrode driver 18*b* produces a reset pulse RPy for initializing wall charges of all of the discharge cells all at once, and a sustaining pulse IDy for sustaining the lighted pixel or unlighted pixel (sustaining the discharge and emission of light), corresponding to the timing signals from the control circuit 13. These reset and sustaining pulses are applied to the row electrodes Y1–Yj at the respective timings.

The column electrode driver 17 is connected to column electrodes D1–Dk. The column electrode driver 17 produces a pixel data pulse DP having voltage corresponding to the logic value "1" or "0" of each bit of the pixel data corresponding to the sub-frame which is applied from the frame memory 16. The pixel data pulse DP is applied to the column electrodes D1–Dk.

The logic value "1" of each bit of the converted pixel data A and B shown in FIGS. 4 and 5 indicates the selection (emission of light), and the logic value "0" indicates the non-selection (non-emission of light).

In FIGS. 4 and 5, mark "○" in the sub-frame arrangement indicates light-emitting sub-frame, and the blank indicates sub frame of non-emission of light.

Figure 6:
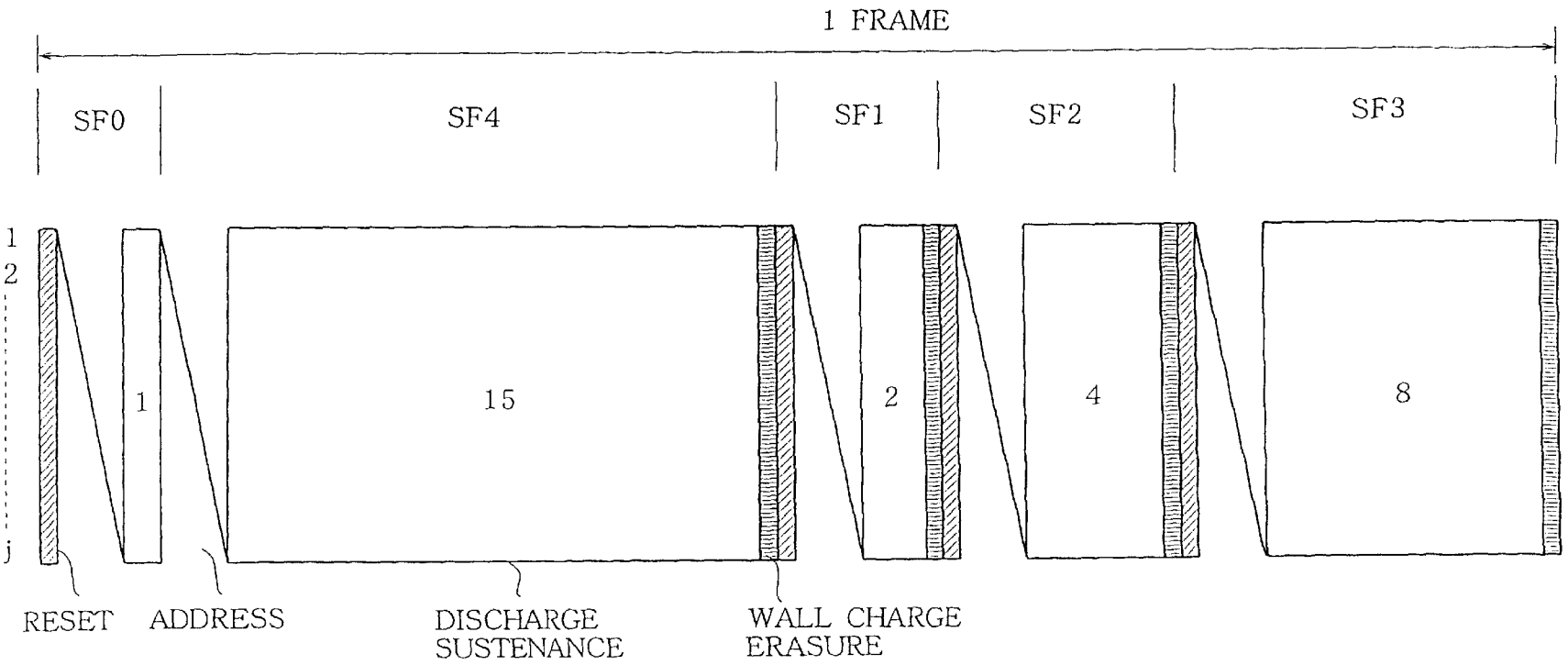
FIG. 6 shows a composition of sub-frames in one frame.

The light emitting period and digit position of each sub-frame in FIG. 6 shows a display period of one frame which is divided into five sub-frames SF0 to SF4 corresponding to each bit digit of the pixel data of 5 bits.

Namely in the first embodiment of the present invention shown in FIGS. 4 to 6, the luminance ratios of the sub-frames are $2^0=1$, $2^1=2$, $2^2=4$, $2^3=8$, and $(2^4-2^2)=15$. The sub-frame SF0, the number of light emitting time of which is $L\cdot 2^k=1$ (L=1 (constant), k=0), and the sub-frame SF4, the number of light emitting time of which is $L\cdot(2^m-2^k)=15$ (L=1, k=0, m=4) are adjacently disposed as one group. At the other sub-frames, the numbers are calculated in the same manner as the above.

As shown in FIG. 4, in the range of the luminance level less than $2^m=16$ (m=4), only the sub-frame SF0 is selectively lighted in the sub-frame block of SF0 and SF4. In the range more than $2^m=16$, the sub-frame SF0 and SF4 are lighted as shown in FIG. 5. Here, $0 \leqq k\ m<n$, $m+k<n$, $1 \leqq L$.

As described above, in the case of pixel data of 5 bits, four bits of lower digits (1, 2, 4, 8 of FIG. 4) are used in the range of luminance levels between 0 and 15, four bits of upper digits (2, 4, 8, 15 of FIG. 5) are used in the range of luminance levels between 16 and 31 (FIG. 5). Since the sub-frames at the luminance level 1 and the sub-frames at the luminance level 16 are not simultaneously emitted, the sub-frame SF0 and the sub-frame SF4 are adjacently disposed in a block. Namely, discharge cells at the luminance levels between 0 and 15 are necessarily non-lighted at the sub-frame 4, discharge cells at the luminance levels between 16 and 31 are emitted at sub-frames SF0 and SF4.

Figure 7:
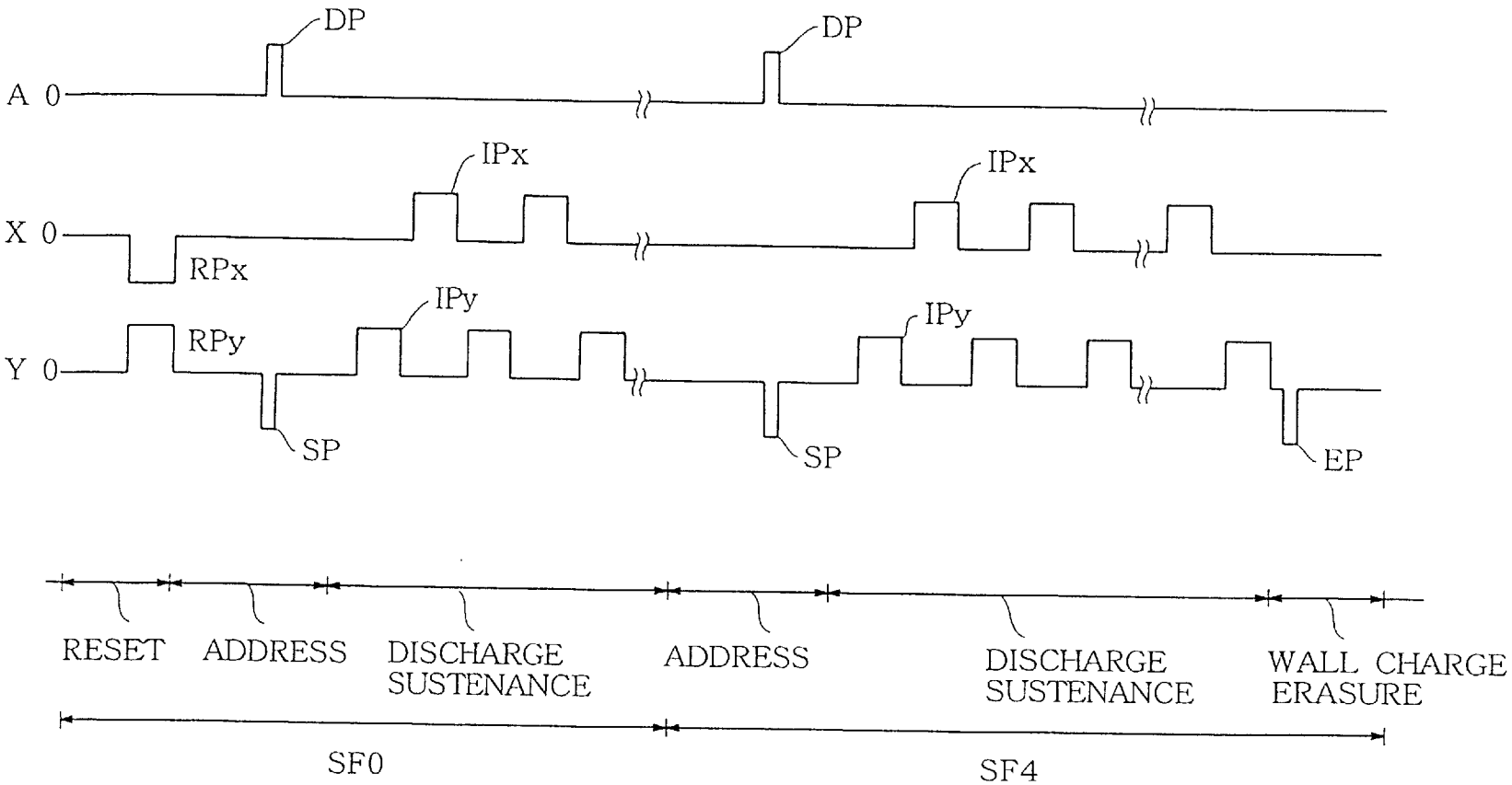
FIG. 7 is a timing chart of driving pulses in a first embodiment of the present invention.

Referring to FIG. 7, reset pulsees RPx and RPy are applied to each of the row electrodes X and Y in the reset period of the first sub-frame SF0 of the block. Thus, all of the row electrodes in pairs in the PDP are excited to discharge, thereby producing charged particles. Thereafter, when the discharge is finished, wall charge is formed and accumulated on the discharge cell.

Then, pixel data pulses DP corresponding to the pixel data for every row are applied to the column electrodes in order in accordance with display data. At that time, scanning pulses (selecting and erasing pulses) SP are applied to the row electrodes Y in order in synchronism with the timings of the data pulse DP (address period).

Next, a charge sustaining pulses IPx and IPy are applied to the row electrodes X and Y.

During the discharge sustaining pulses are continuously applied, the pixel which holds the wall charge sustains the discharge and emission of light (A discharge sustaining period).

The next period of the sub-frame SF4 comprises the address period, discharge sustaining period, and wall charge erasing period for erasing wall charge in all discharge cells.

At that time, in the sub-frames SF0-SF4, light is emitted 1 time, 2 times, 4 times, 8 times and 15 times.

As described above, the discharge cell in which the selecting operation (selecting operation of lighting cell and non-lighting cell) is performed in the address period of the SF4 has necessarily been selected (non-erasing) in the address period of the SF0 in the block, and hence the discharge cell has been in the lighting condition in the discharge sustaining period. In the discharge cell, wall charge remains at the end of the discharge sustaining period. By using the remaining wall charge, it is possible to perform the selecting operation in the address period of the sub-frame SF4.

Each of the other sub-frames SF1, SF2, and SF3 which are not disposed as a block comprises the reset period, address period, discharge sustaining period, and wall charge erasing period.

In the case of 5 bits display data, 5 sub-frames, and 4-bit high luminous parts, the number of the reset discharge is four times.

As described above, the number of bits is decreased, and the reset period is commonly used in at least two sub-frames (namely, by one time of reset discharge, selecting operation of at least two times is performed). Therefore, the number of reset discharges can be reduced without decreasing the number of bits in the low luminance parts, although in the low luminance parts, the reduction of the tone is remarkable if the number of bits is reduced. In the high luminance parts, tone deterioration is not remarkable even if the bit number is reduced.

Figure 8:
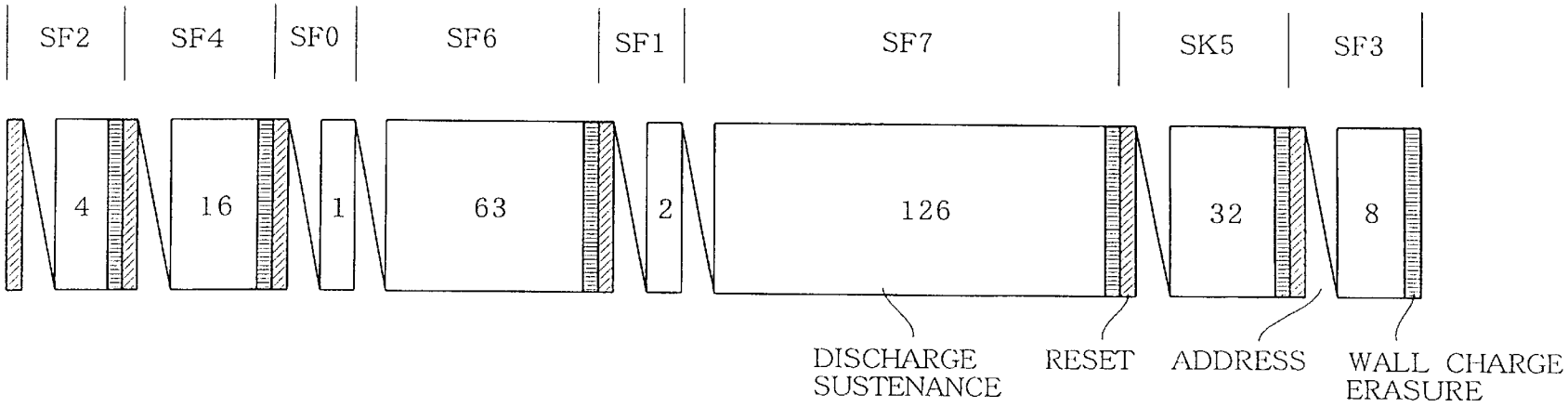
FIG. 8 shows a composition of sub-frames in a second embodiment.

FIG. 8 shows a sub-frame composition of a second embodiment of the present invention. One frame is divided into eight sub-frames SF0 to SF7.

The luminance ratios of the sub-frames are $2^0=1$, $2^1=2$, $2^2=4$, $2^3=8$, $2^4 16$, $2^5=32$, $(2^6-2^0)=63$, and $(2^7-2^1)=126$. The sub-frame SF0, the number of light emitting time of which is $L\cdot 2^k=1$ (L=1, k=0), and the sub-frame SF6, the number of light emitting time of which is $L\cdot(2^m-2^k)=1\cdot(2^6-2^0)=63$ (L=1, k=0, m=6) are adjacently disposed as one group. The sub-frame SF1, the number of light emitting time of which is $2^1=1$, and the sub-frame SF7 of $1\cdot(2^7-2^1)=63$ are adjacently disposed as another sub-frame group.

In the range of the luminance level less than $2^m=64$ (m=6), the sub-frames SF0 and SF1 are selectively lighted in the sub-frame block of SF0 and SF4. In the range more than $2^m=64$, the sub-frames SF0 and SF6 are lighted. In the range more than 64 and less than 128 (m=7), sub-frame SF1 is lighted. In the range more than 128, sub-frames SF1 and SF7 are lighted.

As above described, one frame is divided into eight sub-frames of SF0, SF1 . . . SF7 in ascending order of weight. In the range of the luminance level (tone) 0–63, the lower 6 bits are used, in the range of 64–127, 6 bits except the upper most bit and lower most bit are used. In the range of 128–255, upper 6 bits except lower 2 bits. Namely, at every time when the digit of data value (luminance level) is carried, lower bits is reduced one by one, thereby reducing the number of bits in the higher luminance parts.

Since sub-frames of the luminance levels of 1, 64, 2, and 128 are not simultaneously lighted with each other, the sub-frames SF0 and SF6, SF1 and SF7 are adjacently disposed as blocks, respectively.

At the first sub-frames SF0, and SF1 in respective blocks, reset pulses RPx and RPy are applied to each of the row electrodes X and Y. Thus, all of the row electrodes in pairs in the PDP are excited to discharge, thereby producing charged particles. Thereafter, when the discharge is finished, wall charge is formed and accumulated on the discharge cell.

Then, pixel data pulses DP corresponding to the pixel data for every row are applied to the column electrodes in order in accordance with display data. At that time, scanning pulses (selecting and erasing pulses) SP are applied to the row electrodes Y in order in synchronism with the timings of the data pulse DP (address period).

Next, a charge sustaining pulses IPx and IPy are applied to the row electrodes X and Y.

During the discharge sustaining pulses are continuously applied, the pixel which holds the wall charge sustains the discharge and emission of light (A discharge sustaining period).

Each of the next period of the sub-frames SF6 and SF7 comprises the address period, discharge sustaining period, and wall charge erasing period for erasing wall charge in all discharge cells.

Each discharge cell is selected (non-lighting) in the address period of sub-frames SF0 when the luminance level is 1, thereby becoming a lighting cell. When the luminance level is 64, the discharge cell becomes the lighting cell in the address period of each of sub-frames SF0 and SF6. In the case of luminance level 2, the discharge cell becomes the lighting cell in the address period of sub-frame SF1. When the luminance level is 128, the discharge cell becomes the lighting cell in the address period of each of sub-frames SF1 and SF7.

As described above, the discharge cell in which the selecting operation (selecting operation of lighting cell and non-lighting cell) is performed in the address period of each of the sub-frames SF6 and SF7 has necessarily been selected (non-erasing) in the address period of each of the first sub-frames SF0 and SF1 in the block, and hence the discharge cell has been in the lighting condition in the discharge sustaining period. In the discharge cell in the first sub-frames SF0 (SF1), wall charge remains at the end of the discharge sustaining period. By using the remaining wall charge, it is possible to perform the selecting operation in the address period of each of the sub-frames SF6 and SF7.

The discharge cell, which is not selected (erase) in the address period of each of first sub-frames SF0 and SF1 in the block, is not selected (non-erasing) in the address period of each sub-frame SF6 (SF7).

Each of the other sub-frames SF2, SF3, SF4 and SF5 which are not composed in a block comprises the reset period, address period, discharge sustaining period, and wall charge erasing period.

In the case of 8 bits display data, 5 sub-frames, and 6-bit high luminous parts, the number of the reset discharge is six times.

As described above, the number of bits is decreased, and the reset period is commonly used in at least two sub-frames (namely, by one time of reset discharge, selecting operation of at least two times is performed). Therefore, the number of reset discharges can be reduced without decreasing the number of bits in the low luminance parts, although in the low luminance parts, the reduction of the tone is remarkable if the number of bits is reduced. In the high luminance parts, tone deterioration is not remarkable even if the bit number is reduced.

Figure 9:
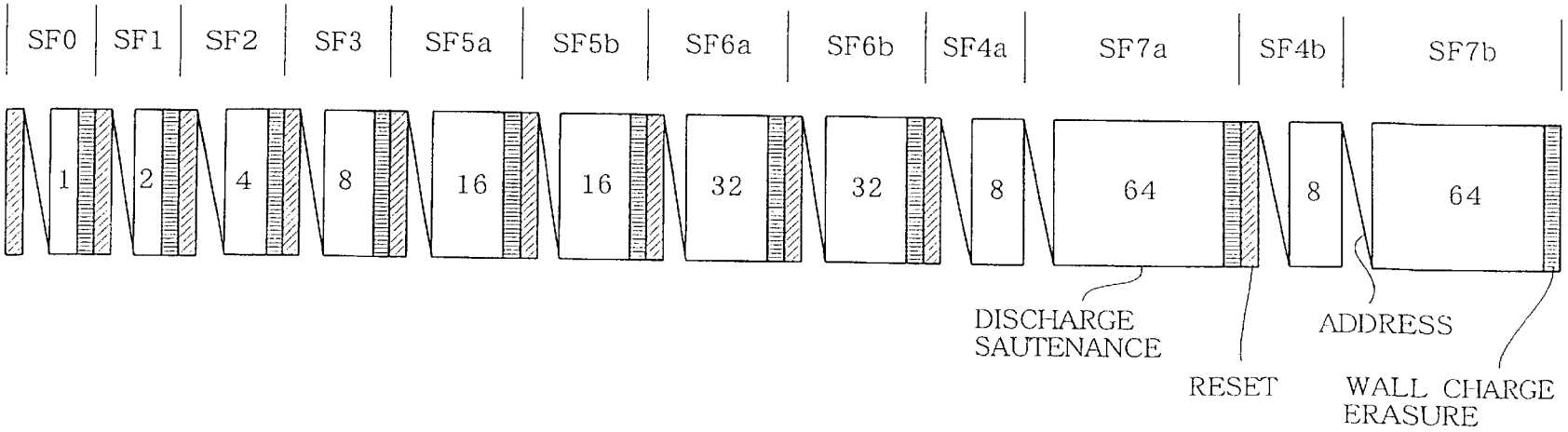
FIG. 9 shows a composition of sub-frames in a third embodiment.

FIG. 9 shows a sub-frame composition of a third embodiment of the present invention. In the case that images are displayed by using display data of 8 bits in the range between the luminance levels 0 and 256, false contours appear on the image. In the third embodiment, as measures for the false contour, heavily weighted four sub-frames SF4 to SF7 corresponding to four bits of upper order are divided into two sub-frames, respectively. Namely, tone display is performed by twelve sub-frames.

In this case, it is possible to provide an emitting pattern in which each discharge cell is not selected (erase) in the address periods of sub-frames SF4*a* and SF4*b*, and selected (non-erasing) in the address periods of the sub-frames SF7*a* and SF7*b*. Therefore, the sub-frames SF4*a* and SF7*a*, and the sub-frames SF4*b* and SF7*b* can adjacently be disposed in blocks, respectively.

Each of the first sub-frames SF4*a* and SF4*b* of the respective blocks comprises the reset period for applying reset pulses to row electrodes X and Y in pairs for forming wall charges in all discharge cells, the address period for selectively erasing the wall charges to select lighting cells and non-lighting cells in accordance with the pixel data, and the discharge sustaining period for sustaining lighting cells and non-lighting cells. Each of sub-frames SF7*a* and SF7*b* following the sub-frames SF4*a* and SF4*b* comprises the address period, discharge sustaining period, and wall charge erasing period.

As described above, the discharge cell in which the selecting operation (selecting operation of lighting cell and non-lighting cell) is performed in the address period of each of the sub-frames SF7*a* and SF7*b* has necessarily been selected (non-erasing) in the address period of each of the first sub-frames SF4*a* and SF4*b* in the block, and hence the discharge cell has been in the lighting condition in the discharge sustaining period. In the discharge cell in the first sub-frames SF4*a* (SF4*b*), wall charge remains at the end of the discharge sustaining period. By using the remaining wall charge, it is possible to perform the selecting operation in the address period of each of the sub-frames SF7*a* and SF7*b*.

Therefore, by commonly using the reset period at two sub-frames, the number or reset discharges for twelve sub-frames can be reduced to ten times.

Figure 10:
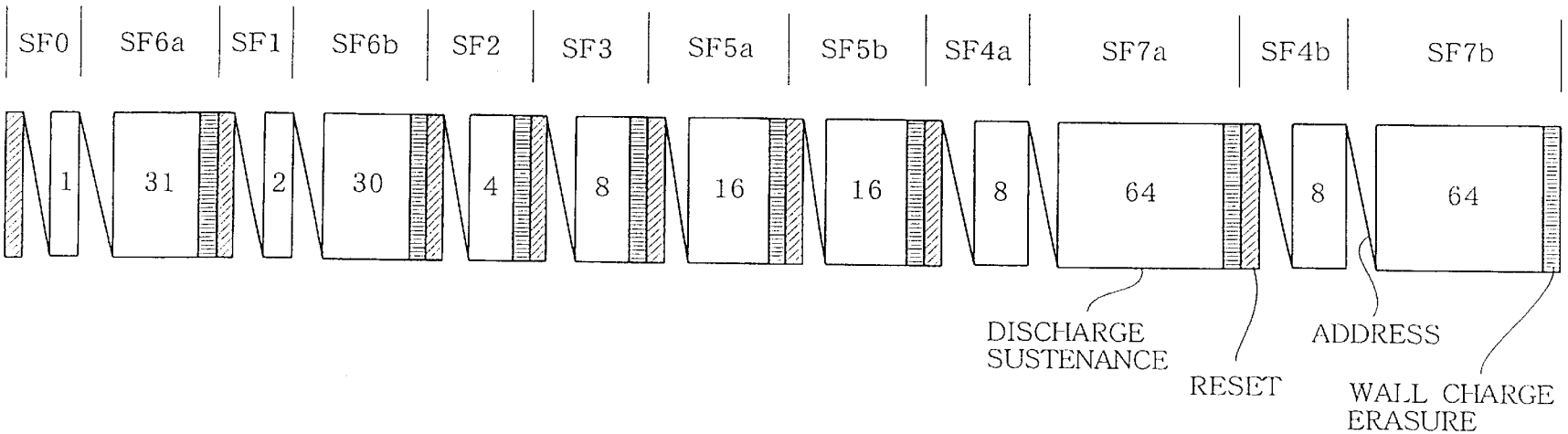
FIG. 10 shows a composition of sub-frames in a fourth embodiment.

FIG. 10 shows a sub-frame composition of a fourth embodiment of the present invention. As measures for the false contour, heavily weighted four sub-frames SF4 to SF7 corresponding to four bits of upper order are divided into two sub-frames, respectively. Namely, tone display is performed by twelve sub-frames.

In the fourth embodiment, each of high luminance parts comprises 6 bits. Lower 6 bits are used in the range of luminance levels between 0–63. In the range of luminance levels between 64–127, 6 bits except an upper most bit and lower most bit are used, and in the range between 128–255, upper 6 bits except lower 2 bits are used.

Namely, at every carry of the luminance level, a lower 1 bit is subtracted so as to reduce the number of bits in the high luminance parts.

In the embodiment, sub-frames SF0 and SF6*a* and sub-frames SF1 and SF6*b* are formed in blocks, respectively.

As described above, by reducing the number of bits in the high luminance parts to 6 bits and by commonly using the reset period for the two sub-frames, the number of times of the reset discharge in low luminance parts, in which the aggravation of tone due to the decrease of the number of bits, can be reduced to 8 times without reducing the number of bits.

Figure 11:
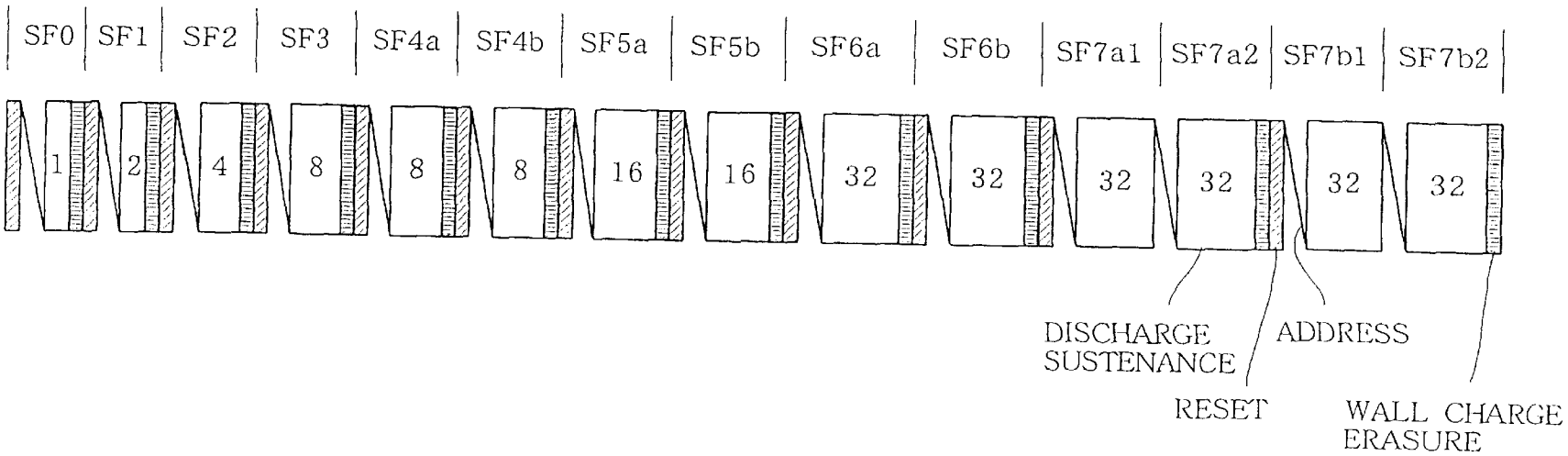
FIG. 11 shows a composition of sub-frames in a fifth embodiment.

FIG. 11 shows a sub-frame composition of a fifth embodiment of the present invention. As measures for the false contour, upper 3 bits, sub-frames SF4, SF5 and SF6 corresponding to upper three bits except the upper most bit are divided into two sub-frames, respectively. The sub-frame SF7 corresponding to the upper most bit is divided into four sub-frames. Thus 14 sub-frames are formed in one frame.

Since the divided sub-frames SF7*a* and SF7*b*, and the divided sub-frames SF7*c* and SF7*d* are simultaneously selected (non-erasing), SF7*a* and SF7*b*, and SF7*c* and SF7*d* can adjacently be disposed as blocks, respectively.

By commonly using the reset period at two sub-frames, the number of times of the reset discharge for 14 sub-frames can be reduced to 12 times.

Figure 12:
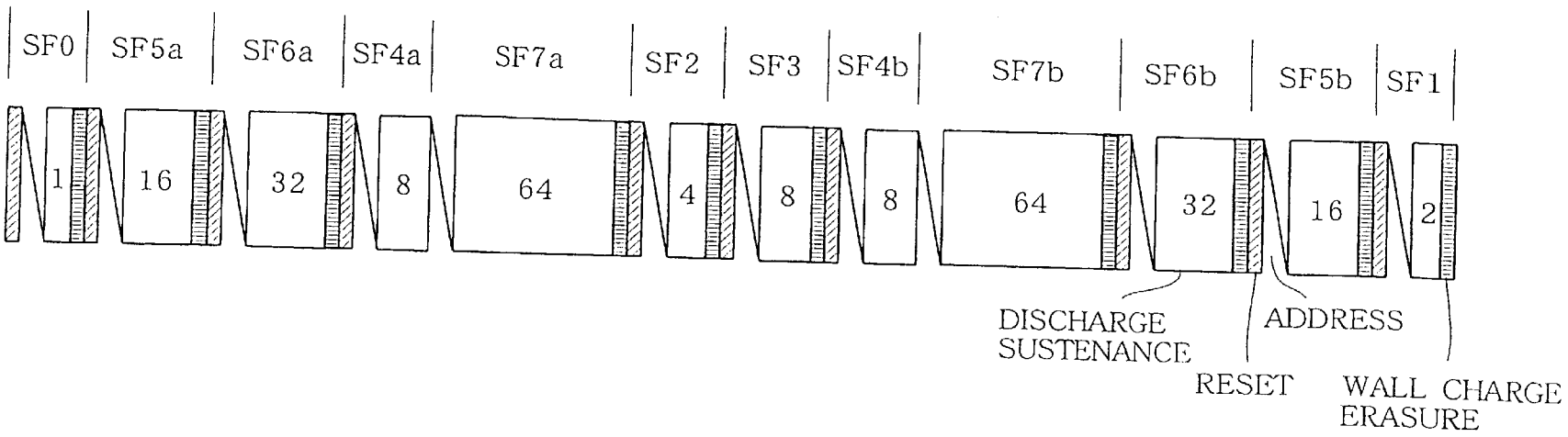
FIGS. 12 to 14 show compositions of sub-frames in sixth to eighth embodiments.

FIG. 12 shows a sub-frame composition of a sixth embodiment of the present invention. As measures for the false contour, heavily weighted four sub-frames SF4 to SF7 corresponding to four bits of upper order are divided into two sub-frames, respectively. Namely, tone display is performed by twelve sub-frames.

This embodiment is different from the third embodiment of FIG. 9 in that dispositions of sub-frames in one frame are changed.

Namely, lightly weighted sub-frames SF2, SF3 are disposed in a central portion. Centering the sub-frames SF2 and SF3, divided sub-frames SF7*a*, SF7*b*, SF6*a*, SF6*b*, SF5*a* and SF5*b* are symmetrically disposed in descending order.

Figure 13:
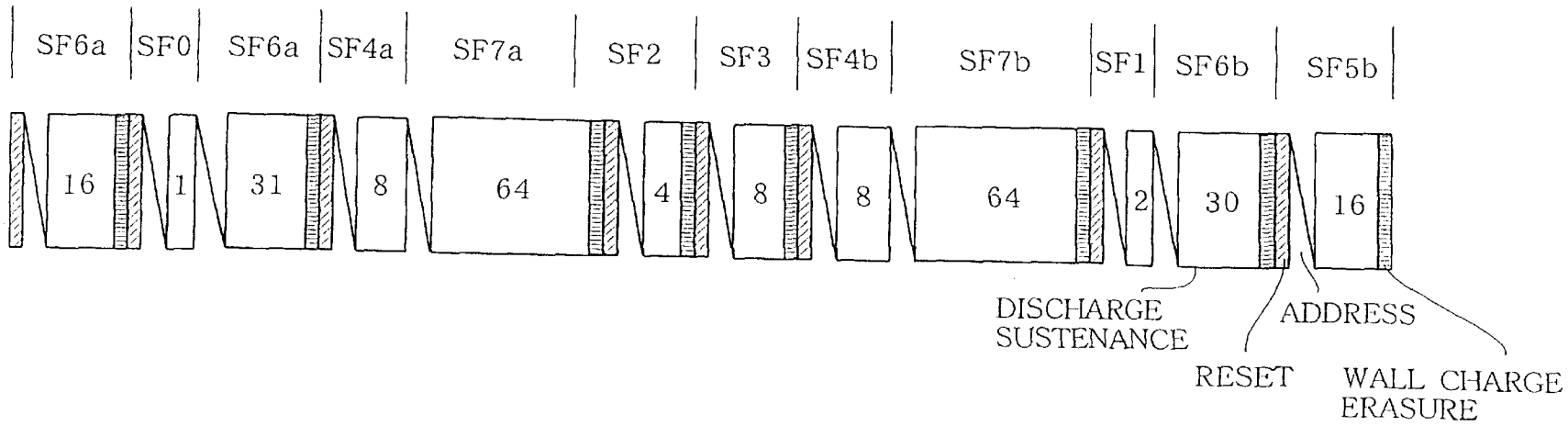

FIG. 13 shows a sub-frame composition of a seventh embodiment of the present invention. As measures for the false contour, heavily weighted four sub-frames SF4 to SF7 corresponding to four bits of upper order are divided into two sub-frames, respectively. Namely, tone display is performed by twelve sub-frames.

This embodiment is different from the embodiment of FIG. 10 in that dispositions of sub-frames in one frame are changed.

Namely, lightly weighted sub-frames SF2, SF3 are disposed in a central portion. Centering the sub-frames SF2 and SF3, divided sub-frames SF7*a*, SF7*b*, SF6*a*, SF6*b*, SF5*a* and SF5*b* are symmetrically disposed in descending order.

Figure 14:
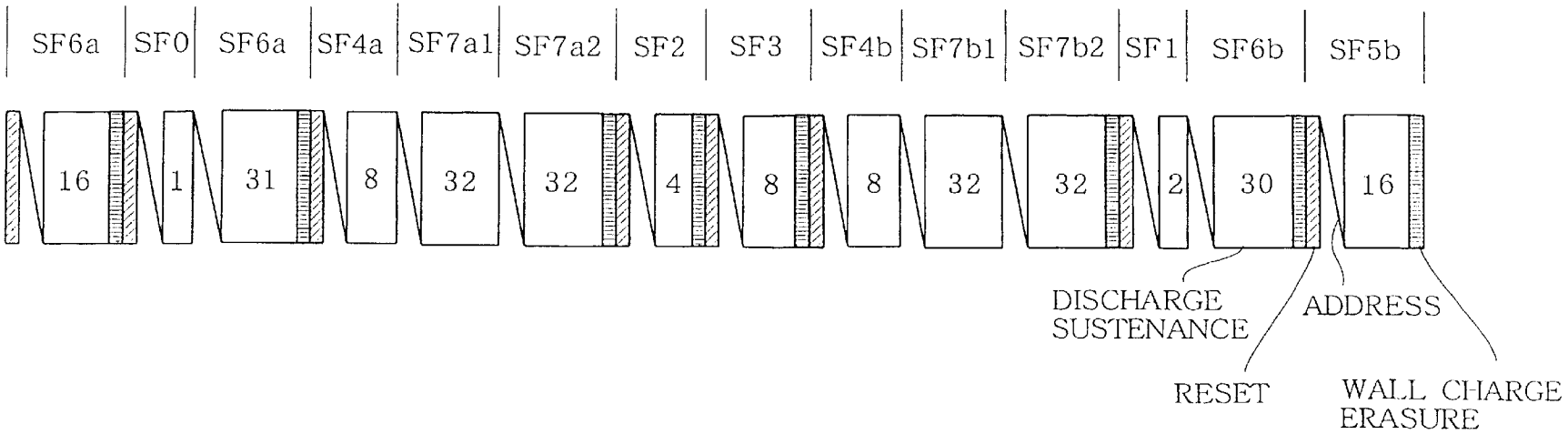

FIG. 14 shows a sub-frame composition of an eighth embodiment of the present invention. As measures for the false contour, upper 3 bits, sub-frames SF4, SF5 and SF6 corresponding to upper three bits except the upper most bit are divided into two sub-frames, respectively. The sub-frame SF7 corresponding to the upper most bit is divided into four sub-frames. Thus 14 sub-frames are formed in one frame.

This embodiment is different from the embodiment of FIG. 13 in that the divided sub-frames SF7*a* and SF7*b* is further divided into two sub-frames, and that SF4*a*, SF7*a*1 and SF7*a*2, and SF4*b*, SF7*b*1 and SF7*b*2 are disposed in blocks, respectively. By commonly using the reset period for the three sub-frames, the number of times of reset discharge for 14 sub-frames can be reduced to 8 times.

Although the above described eight embodiments are applied to the selective erase address method, the present invention can be applied to the selective writing address method, thereby obtaining the same advantages as the above embodiments.

Figure 15:
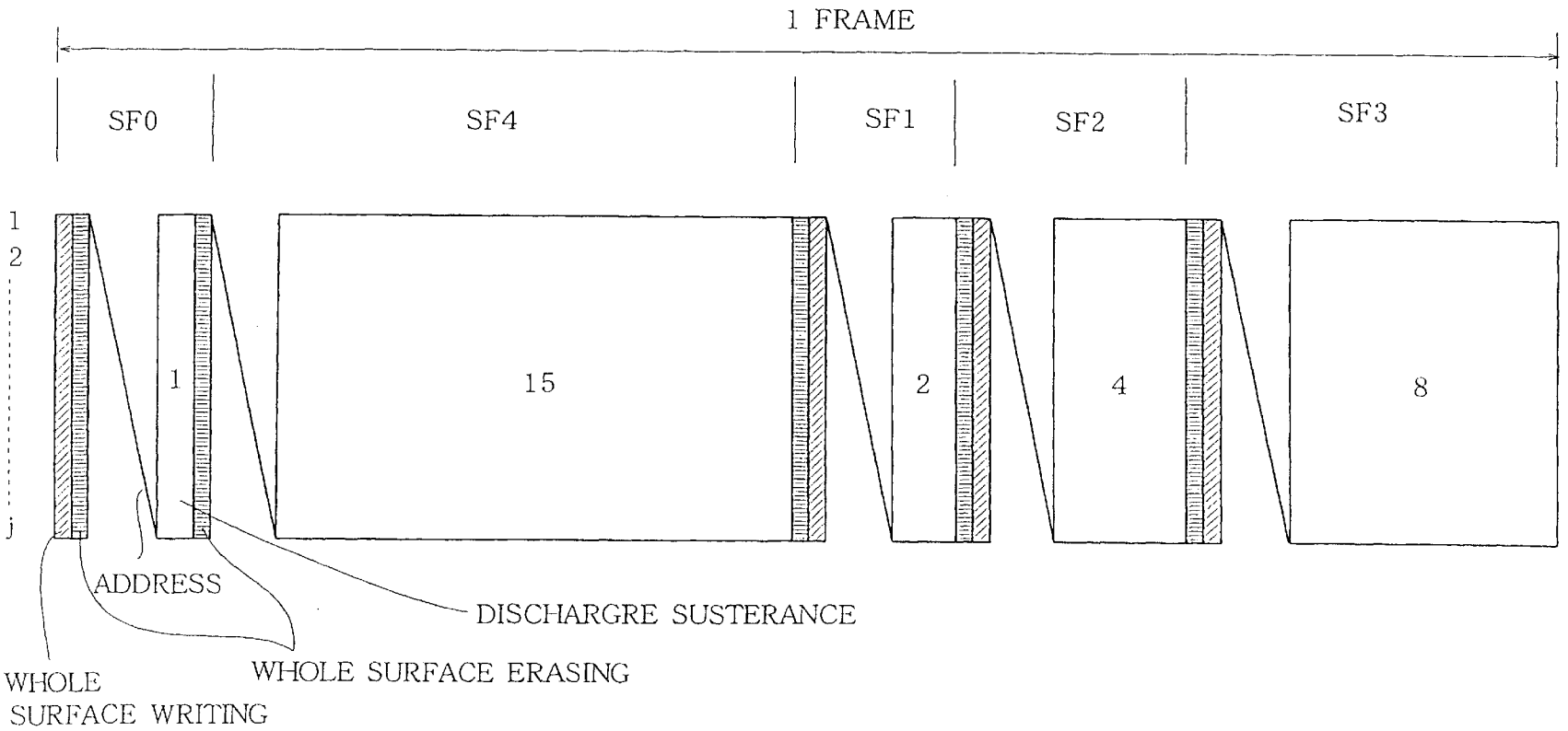
FIG. 15 shows a composition of sub-frames in a selecting writing address method.
Figure 16:
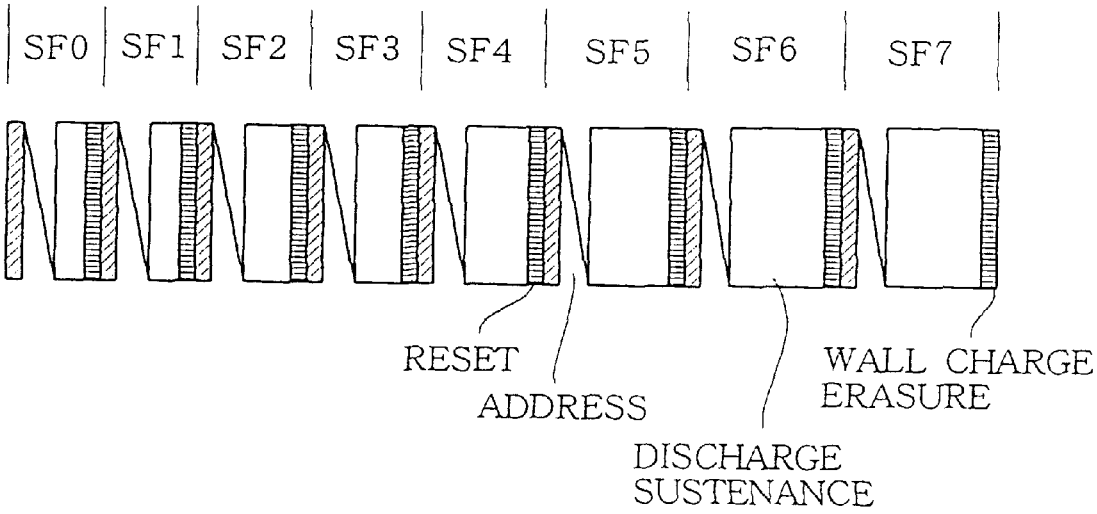
FIG.16 PRIOR ART
FIG. 16 shows a composition of conventional sub-frames.
Figure 17:
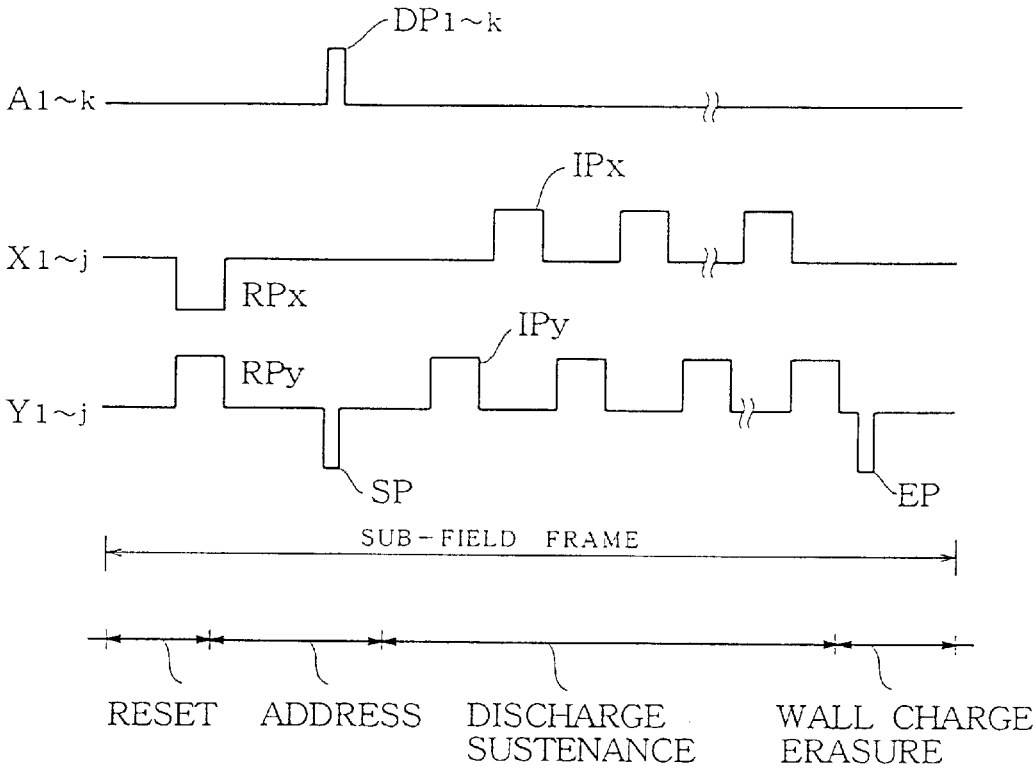
FIG.17 PRIOR ART
FIG. 17 is a time chart of driving pulses in a conventional system.

FIG. 15 shows a one frame composition of a ninth embodiment of the present invention applied to the selective writing address method. In the embodiment, the pixel data comprises five bits. In the range of luminous level between 0–15, lower four bits are used, between 16–31, upper four bits are used. The sub-frame SF0 of 1 light emitting time and the sub-frame SF4 of 15 light emitting times are adjacently disposed in a block. IN discharge cells of luminance levels 0–15, the sub-frame 4 becomes necessarily non-lighting state, and in the discharge cells of luminance levels 16–31, sub-frames SF0 and SF4 become lighting states.

The first sub-frame SF0 of the block comprises a whole surface writing period for applying writing pulses to row electrodes in pairs for forming wall charges in all discharge cells, a first whole surface erasing period for applying erasing pulses each having the same polarity as the wall charge to the row electrodes for erasing the wall charges, an address period for selectively forming the wall charges to select lighting cells and non-lighting cells in accordance with the pixel data, the discharge sustaining period for sustaining lighting cells and non-lighting cells, a second whole surface erasing period for applying erasing pulses each having the same polarity as the wall charge to the row electrodes for erasing the wall charges. The sub-frame SF4 following the sub-frame SF0 comprises the address period and discharge sustaining period.

As described above, the discharge cell in which the selecting operation (selecting operation of lighting cell and non-lighting cell) is performed in the address period of the SF4 has necessarily been selected (non-erasing) in the address period of the SF0 in the block, and hence the discharge cell has been in the lighting condition in the discharge sustaining period. In the discharge cell, wall charge is accumulated at the end of the discharge sustaining period. By using the remaining wall charge, it is possible to perform the selecting writing discharge in the address period of each of the sub-frames SF4.

Each of the sub-frames SF1, SF2, and SF3 which are not in block comprises the whole surface writing period, first whole surface erasing period, address period, and discharge sustaining period. In the case of 5-bit pixel data, 5 sub-frames, and 4-bit high luminance parts, it is possible to reduce the whole surface writing period of 5 times to 4 times.

In the range of the luminance level 0–63, the lower 6 bits are used, in the range of 64–127, 6 bits except the upper most bit and lower most bit are used.

It is possible to adjacently dispose sub-frames SF0 and SF6 and sub-frames SF1 and SF7 in blocks. In such a case, each of the first sub-frames SF0 and SF1 of respective block comprises the whole surface writing period, first whole surface erasing period, address period, discharge sustaining period, and second whole surface erasing period. Each of the sub-frames SF6 and SF7 comprises the address period and discharge sustaining period.

Also in the third to eighth embodiments, each of the first sub-frames of respective blocks comprises the whole surface writing period, first whole surface erasing period, address period, discharge sustaining period, and second whole surface erasing period. Each of the sub-frames following the first sub-frames comprises the address period and discharge sustaining period.

In accordance with the present invention, the reset period is commonly used for a plurality of sub-frames. Therefore, the number of times of the reset discharge can be reduced, so that the contrast can be improved.

While the invention has been described in conjunction with preferred specific embodiment thereof, it will be understood that this description is intended to illustrate and not limit the scope of the invention, which is defined by the following claims.

What is claimed is:

1. A method for driving a plasma display panel wherein one frame of a video signal is divided into a plurality of sub-frames, each of the sub-frames is composed by an address period for selecting light emitting pixels or light non-emitting pixels at every scanning line in accordance with pixel data, and a discharge sustaining period for causing a light emitting pixel to emit at a number of times in accordance with weighting of each sub-frame comprising the steps of:

disposing adjacently a plurality of sub-frames to form at least one sub-frame block, a first sub-frame in the sub-frame block comprising a lightly weighted sub-frame, a sub-frame following the first sub-frame comprising heavily weighted sub-frame; and providing a reset period in the first sub-frame of the sub-frame block so as to initialize all pixels prior to the address period, wherein the activation of the address period of the first sub-frame pre-sets the pixels of the sub-frame following the first sub-frame to be in a light-emitting state, so that when the sub-frame following the first sub-frame arrives, the pixels are in the light-emitting state, and then, the address period of the sub-frame following the first sub-frame selectively indicates which pixels should be deactivated or should remain in the light-emitting state.

2. A method for driving a plasma display panel wherein one frame of a video signal is divided into a plurality of sub-frames, each of the sub-frames is composed by an address period for selecting light emitting pixels or light non-emitting pixels at every scanning line in accordance with pixel data, and a discharge sustaining period for causing a light emitting pixel to emit at a number of times in accordance with weighting of each sub-frame, comprising the steps of:

disposing adjacently a plurality of sub-frames to form at least one sub-frame block, a first-sub-frame in the sub-frame block comprising a most lightly weighted divided sub-frame in a divided sub-frame group which is formed by dividing a plurality of heavily weighted sub-frames including a most heavily weighted sub-frame, a sub-frame following the first sub-frame in the sub-frame block including one of most heavily weighted sub-frames; and providing a reset period in a first sub-frame of the sub-frame block so as to initialize all pixels prior to the address period.

3. A method for driving a plasma display panel wherein one frame of a video signal is divided into a plurality of sub-frames, each of the sub-frames is composed by an address period for selecting light emitting pixels or light non-emitting pixels at every scanning line in accordance with pixel data, and a discharge sustaining period for causing a light emitting pixel to emit at a number of times in accordance with weighting of each sub-frame, comprising the steps of:

disposing adjacently a plurality of sub-frames to form at least one sub-frame block, at least two sub-frames including at least two divided sub-frames which are formed by dividing a most heavily weighted sub frame; and providing a reset period in a first sub-frame of the sub-frame block so as to initialize all pixels prior to the address period.

4. A method for driving a plasma display panel wherein one frame of a video signal is divided into a plurality of sub-frames, each of the sub-frames is composed by an address period for selecting light emitting pixels or light non-emitting pixels at every scanning line in accordance with pixel data, and a discharge sustaining period for causing a light emitting pixel to emit at a number of times in accordance with weighting of each sub-frame, comprising the steps of:

disposing adjacently a plurality of sub-frames to form at least one sub-frame block; and providing a reset period in a first sub-frame of the sub-frame block so as to initialize all pixels prior to the address period, wherein the pixel data comprises n bits, one frame is divided into n sub-frames, sub-frames in the sub-frame block are arranged in such an arrangement that the first is a first sub-frame in which the number of times of light emitting in the discharge sustaining period is $L \cdot 2^k$, the second is a second sub-frame in which the number of times of light emitting in the discharge sustaining period is $L \cdot (2^m - 2^k)$ ($0 \leqq k < m < n$, $m+k < n$, $1 \leqq L$), the first sub-frame is selectively caused to be an emitting state when a luminance level is less than $2^m$, and the first and second sub-frames are caused to be emitting state when the luminance level is more than $2^m$, wherein L represents a constant for setting a number of times of light emission, k represents a number of the first sub-frame, m represents a number of the second sub-frame, and n represents a total number of sub-frames in one frame.

5. The method according to any one of claims 1–4, further comprising steps of:

forming a wall charge in each of the all pixels in the reset period; and selectively erasing the wall charge in each pixel in one of the address periods of the sub-frame block in accordance with the pixel data.

6. The method according to anyone of claims 1–4, further comprising steps of:

forming a wall charge in each of the pixels in the reset period; thereafter erasing the wall charge in all pixels;

selectively forming a wall charge of each pixel in each address period of the sub-frame block in accordance with the pixel data; and providing a whole surface erasing period after each discharge sustaining period in the sub-frame block, for erasing wall charges in emitting pixel.

* * * * *

UNITED STATES PATENT AND TRADEMARK OFFICE

CERTIFICATE OF CORRECTION

PATENT NO. : 6,369,782 B2
DATED : April 9, 2002
INVENTOR(S) : Shigeta

It is certified that error appears in the above-identified patent and that said Letters Patent is hereby corrected as shown below:

Title page,
Item [73], Assignee, should read as follows:
-- Pioneer Electronic Corporation, Tokyo (JP) --

Signed and Sealed this

Ninth Day of November, 2004

JON W. DUDAS
*Director of the United States Patent and Trademark Office*